United States Patent [19]

Palmer

[11] Patent Number: 4,860,503

[45] Date of Patent: Aug. 29, 1989

[54] PLUMBING APPARATUS

[76] Inventor: Winston H. Palmer, #5 Latitude Ct., Newport Beach, Calif. 92663

[21] Appl. No.: 188,899

[22] Filed: May 2, 1988

Related U.S. Application Data

[63] Continuation-in-part of Ser. No. 64,404, Jun. 22, 1987, abandoned.

[51] Int. Cl.[4] ..... A47K 3/16

[52] U.S. Cl. ..... 52/35; 52/220; 4/211

[58] Field of Search ..... 52/34, 35, 218, 219, 52/220; 4/209, 211, 217; 137/357, 360, 362

[56] References Cited

U.S. PATENT DOCUMENTS

| | | | |
|---|---|---|---|
| 2,248,075 | 7/1941 | Groeniger | 52/220 |
| 2,482,359 | 9/1949 | Molloy | 4/211 X |
| 3,765,036 | 10/1973 | Dykstra | 52/35 X |
| 3,978,529 | 9/1976 | Krafft | 52/35 X |
| 4,341,052 | 7/1982 | Douglass, Jr. | 52/742 |

*Primary Examiner*—David A. Scherbel
*Assistant Examiner*—Creighton Smith
*Attorney, Agent, or Firm*—Jack C. Munro

[57] ABSTRACT

A waste water plumbing apparatus connecting waste water depositing receptacles between the different stories of a building. The waste water plumbing apparatus comprises principally a vent pipe and a waste pipe. Connected to the vent pipe is a waste depositing receptacle. A similar waste depositing recptacle being connected to the waste pipe. These waste depositing receptacles are located in different locations. The vent pipe and the waste pipe are located in extemely close proximity to one another and may actually be physically connected together entirely along their longitudinal length. Both the vent pipe and waste pipe are connected at their lowest level to a discharge sewer line. The highest level of the vent pipe is open and extends through the roof of the building structure within which it is mounted. The waste pipe is connected to the vent pipe in the area of the roof. There may be included a plurality of connecting pipes connected between the waste pipe and the vent pipe with each connecting pipe being connected to a waste depositing receptacle. There may also be attached to the waste pipe and vent pipe the hot and cold water supply pipes.

3 Claims, 3 Drawing Sheets

PLUMBING APPARATUS

REFERENCE TO PRIOR APPLICATION:

This application is a continuation-in-part of patent application Ser. No. 07/064,404, filed June 22, 1987, by the same title and by the same inventor now abandoned.

BACKGROUND OF THE INVENTION

The field of this invention relates to plumbing and more particularly to a waste water piping system designed to be utilized in conjunction with multi-storied buildings.

In the constructing of any multi-storied buildings such as condominiums, office buildings or apartments, it is normal to include multiple plumbing fixtures throughout the building. Within each apartment, office or condominium, there will be located one or more sinks, one or more toilets, and one or more bathtubs.

In order to minimize the amount of plumbing within the building, it is common to design the offices, condominiums or apartments, so that the plumbing fixtures within one story are in vertical alignment with the plumbing fixtures of another story. In other words, it is common for the bathrooms of the individual units to be in vertical alignment.

With these bathrooms in vertical alignment, a single vent pipe can be installed which connects with the bathroom of each unit with the upper end of the vent pipe extending above the roof of the building and being open to the atmosphere. Also, the sink, toilet or bathtub of an upper level unit can deposit its waste into a pipe which extends to a lower unit which in turn is also designed to receive waste liquid from the sink, bathtub, and/or toilet of this lower unit.

In order to comply with building code requirements, it is necessary that an upper level toilet not discharge directly into the piping of a lower level toilet. In other words, the contents of each toilet, in essence, must have a direct channel into the sewer line in order to minimize the possibility of clogging the pipes causing flooding within the lower leveled stories and also prevent the seepage of sewage gas into the lower stories.

Previous to the present invention, the installing of plumbing within a multi-storied building was constructed in a custom manner. In other words, the plumber installs the vertical piping necessary to provide an outlet for the waste contents of the plumbing fixtures to be disposed of in the sewer line and then installs each of the plumbing fixtures and its associated piping at the job sight. It is common that a substantial amount of space is required in the installing of the piping for these plumbing fixtures. Generally, the one or more vent pipes might be located some distance from the one or more waste water pipes. Both such pipes are required in order to complete a plumbing system. This custom installation of the piping requires the cutting of holes within wood supporting frame members of the building structure in order to permit pipe to pass from one story to another story. This custom installation generally requires forming of a number of such holes plus individual soldering of a number of piping joints. This custom type of installation is labor intensive and time consuming.

The installation of plumbing is accomplished simultaneously with the building of the other portion of the structure. It is exceedingly common that the plumber is just not able to keep up with the building of the structure and it is usual that the plumber ends up being "buried". In other words, wallboard or other types of wall coverings end up having to be broken into or removed in order to complete the installation of the piping.

SUMMARY OF THE INVENTION

A water waste plumbing apparatus to connect together substantially vertically aligned waste deposit receptacles within a multi-story building. The waste water plumbing apparatus of this invention is to be prefabricated at a site exterior of the job site forming two, three or four prefabricated units for each waste water pipe installation. The vent pipe and the waste pipe of each plumbing installation are to be located in close proximity and may even be connected together. For three-story (and greater) buildings there will be incorporated one or more connecting pipes connecting the waste pipe and the vent pipe. Within each connecting pipe is to be mounted a separate waste deposit receptacle with this waste deposit receptacle being located at a story of the building. The vent pipe and the waste pipe, plus any connecting pipes, for a single series of vertically aligned waste deposit receptacles will be located between a directly adjacent pair of wood framing studs of the building. In other words, it is not necessary to spread out the location of the plumbing piping between several studs. This confining of the piping between a single pair of studs facilitates installation and subsequent repair, if needed. Separate water supply piping can be attached directly onto the plumbing piping. This attachment is by a series of brackets which use an adjustable band for easy and quick installation of the water piping to the vent pipe and waste pipe.

The primary objective of the present invention is to utilize a plumbing system for a multi-storied building which permits some initial installation at a location other than at the job site thereby minimizing the labor and time of installation at the job site.

Another objective of the present invention is to utilize a plumbing system for a multi-storied building which includes all portions of the plumbing in a small horizontally confined space thereby eliminating the "spreading out" of the plumbing over a substantial horizontally defined area.

Another objective of the present invention is to utilize a plumbing system which substantially decreases the cost of installation required of the plumbing within a multi-storied building.

Another objective of the present invention is to utilize a plumbing system wherein the installation itself can be achieved by relatively unskilled laborers.

Another objective of this invention is to permit water supply piping to be mounted on the waste water piping thereby eliminating the need for a separate installation and resulting in a condensing of all piping between a single pair of studs.

DETAILED DESCRIPTION OF THE SHOWN EMBODIMENT

Figure 1:
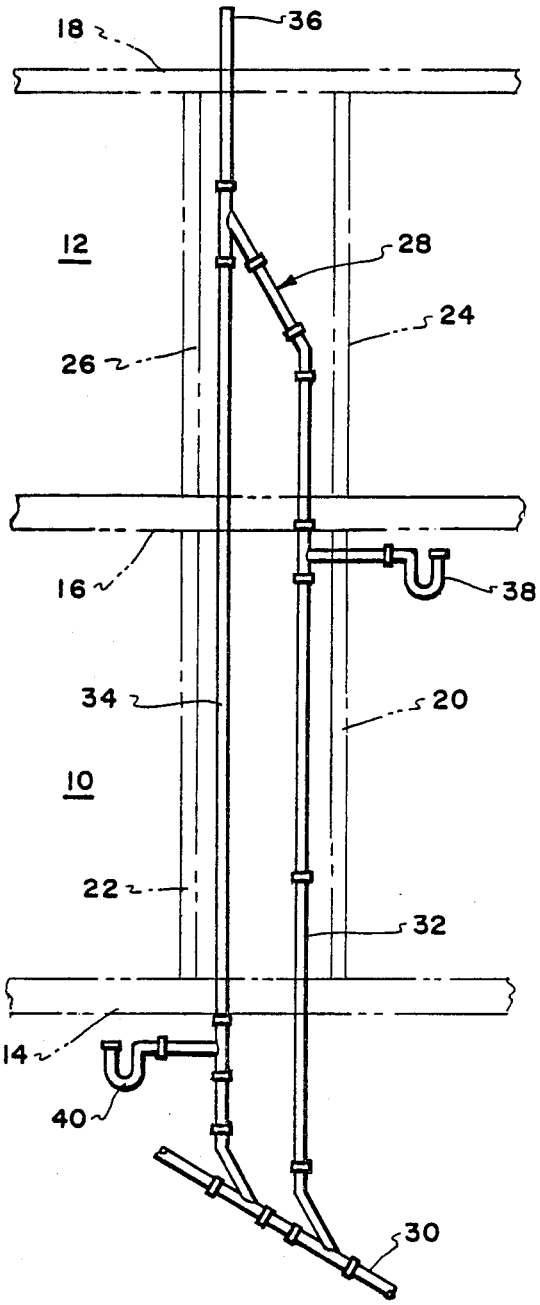
FIG. 1 is a side elevational view showing the waste water plumbing apparatus of the present invention utilized in conjunction with a two story building.

Referring particularly to FIG. 1 of the drawings, there is generally shown stories 10 and 12 of a building with story 10 being the lowermost story and 12 being the uppermost story. The story 10 is formed by base floor 14 and a ceiling 16. The ceiling 16 forms the floor of story 12 with the roof 18 closing off the upper level of the story 12. Depicted within FIG. 1 are vertical studs 20 and 22 located in a parallel relationship within the story 10. Also, there are vertical studs 24 and 26 located again in a parallel relationship within the story 12. Normally, the studs 20 and 22, and 24 and 26, will be no more than sixteen inches apart.

Located between the studs 20 and 22, and 24 and 26 is the plumbing apparatus 28 of this invention. Plumbing apparatus 28 is to be connected to a sewer line 30 located beneath the base floor 14. It is the function of the sewer line 30 to direct waste water and waste matter into a sewer pipe (not shown) located some spaced distance from the building structure. It is to be noticed in the drawing that the sewer line 30 has its end cut off. This sewer line 30 will generally be connected to a plurality of the plumbing apparatuses 28 with only one apparatus 28 being shown. The sewer line 30 will generally be horizontal with the plumbing apparatus 28 being vertical. The sewer line 30 is commonly located parallel to the base floor 14.

Connected to the sewer line 30 is a waste pipe 32. Also connected to the sewer line 30 is a vent pipe 34. The waste pipe 32 and vent pipe 34 are located substantially parallel to each other with the upper end of the waste pipe 32 connecting into the vent pipe 34 directly adjacent the roof 18. It is to be noted that the vent pipe 34 extends exteriorly of the roof 18 and has an open upper end 36.

Connected to the waste pipe 32 is a waste receiving drain 38. A similar waste receiving drain 40 is connected to the vent pipe 34. The drain 38 is shown located directly adjacent the floor 16 with the waste receiving drain 40 being shown directly adjacent the base floor 14. It is to be noted that both the drains 38 and 40 are adapted to be connected with a waste depositing receptacle such as a water closet which is commonly referred to as a toilet.

The structure shown in FIG. 1 is designed to be utilized in conjunction with a two-story building. The vent pipe 34 could be made as a single unit exteriorly of the building structure which would have attached thereto the drain 40. Also, the waste pipe 32 could also be manufactured at an exterior location which would include the drain 38. At the building structure, it would then be only necessary for the plumber to install the pipes 32 and 34 in position connecting together the upper end of the waste pipe 32 to the vent pipe 34. The pipes 32 and 34 are then connected to the sewer line 30 and the installation is then complete ready for connection to the waste depositing receptacle (not shown).

Figure 5:
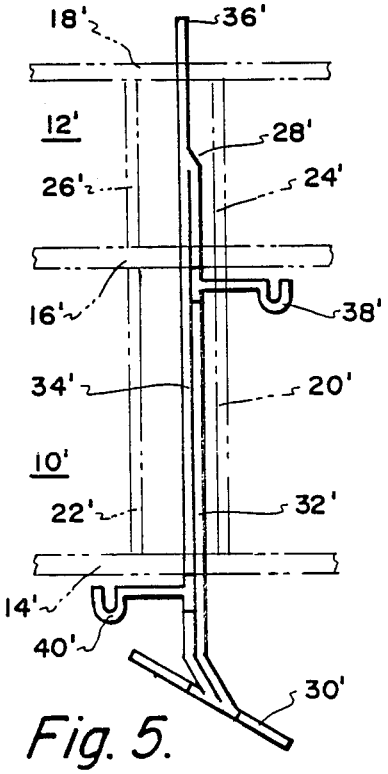
FIG. 5 is a modified form of the apparatus of this invention which shows the vent pipe and the waste pipe physically connected together in order to condense the space required during its installation.

Reference is to be had to FIG. 5 of the drawings where a modified form of the structure of FIG. 1 is shown. Like numerals have been utilized to refer to like parts. The only difference of the structure of FIG. 5 is that the waste pipe 32′ is physically connected to the vent pipe 34′ and that the pipes 32′ and 34′ are in essence manufactured as a single unit. The reason that this can be done is that the spacing between the drains 38′ and 40′ in most installations are almost identical varying at the most an inch or two. Also, the length of the apparatus 28′ would be the same since the pipe of the stories 10′ and 12′ is a standard size as well as the thickness of the floors 14′ and 16′, and the roof 18′. Therefore, when the apparatus 28′ is taken to a job site, it is only necessary for the apparatus 28′ to be connected into the sewer line 30′.

Figure 2:
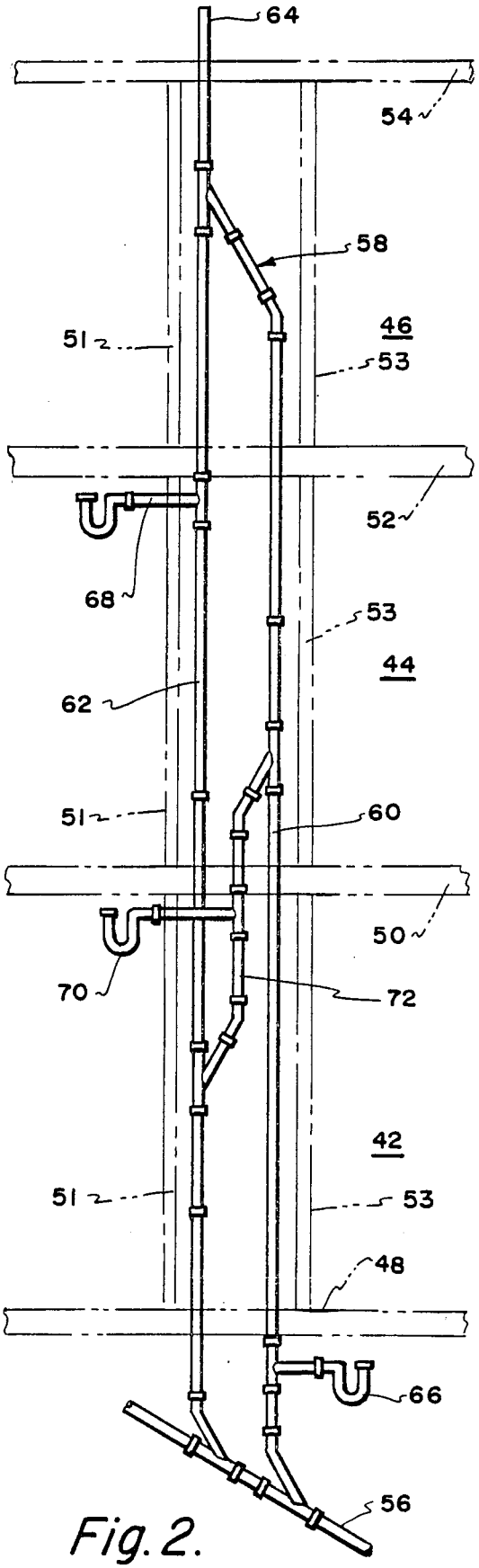
FIG. 2 is a view similar to FIG. 1 showing the apparatus of this invention to be utilized in conjunction with a three story building.

Referring particularly to FIG. 2 there is shown a three-story building composed of stories 42, 44 and 46. Located at the bottom level of story 42 is a base floor 48 with ceiling 50 forming the upper level of story 42. The ceiling 50 also functions as the floor of story 44 with the upper level of story 44 being closed by a ceiling 52. Again, the ceiling 52 forms the floor of story 46 with the upper level of story 46 being closed by a roof 54. Vertically supporting the floors 50 and 52 and the roof 54 relative to base floor 48 are studs 51 and 53. Located beneath the base floor 48 is a sewer line 56. Connected with the sewer line 56 is a plumbing apparatus 58 which is formed of a waste pipe 60 and a vent pipe 62. The upper end of the waste pipe 60 connects with the vent pipe 62 located directly adjacent the roof 54. Again, the vent pipe 62 passes through the roof 54 and has an open outer end 64.

Connected with the waste pipe 60 located beneath the base floor 48 is a waste receiving drain 66 which is again adapted to connect to a toilet. A similar toilet waste receiving drain 68 is connected to the vent pipe 62 located directly adjacent the ceiling 52.

It can thus be seen that a toilet waste receiving drain 68 is located for story 46 and a toilet waste receiving drain 66 is located for story 42. At this particular moment there is no toilet receiving drain for story 44.

In order to provide a waste receiving drain for story 44, there is shown the waste receiving drain 70. The drain 70 connects to a connecting pipe 72. The upper end of the connecting pipe 72 connects with the waste pipe 60 with the lower end of the connecting pipe 72 connecting to the vent pipe 62. The waste receiving drain 70 cannot connect directly to pipes 60 or 62 since this type of connection is normally against code. It is necessary that the drain 70 have its own separate connecting pipe, such as pipe 72, with that pipe in turn being connected to vent pipe 62 so that the discharged contents from the drain 70 will first pass through pipe 72 prior to being deposited within the pipe 62.

Again, the portion of the pipe 62 from open end 64 to adjacent connection with pipe 72, and also the portion of the pipe 60 to the point of connection with pipe 72, can be manufactured as a single unit exteriorly of the job site. Still further, the portion of the pipes 62 and 60 which are to be connected to the sewer line 56 can be manufactured exteriorly of the job site. The pipe 72, as well as its drain 70, can also be manufactured exteriorly of the job site. Therefore, it will only be necessary for the plumber to assemble the three separate units at the job site minimizing installation time.

It is to be noted that although in FIG. 2 there is only being shown drains 66, 68 and 70 each of which are to connect to a toilet, it is to be understood that a similar system could be utilized to connect to lavatories, sinks, or bathtubs.

Figure 3:
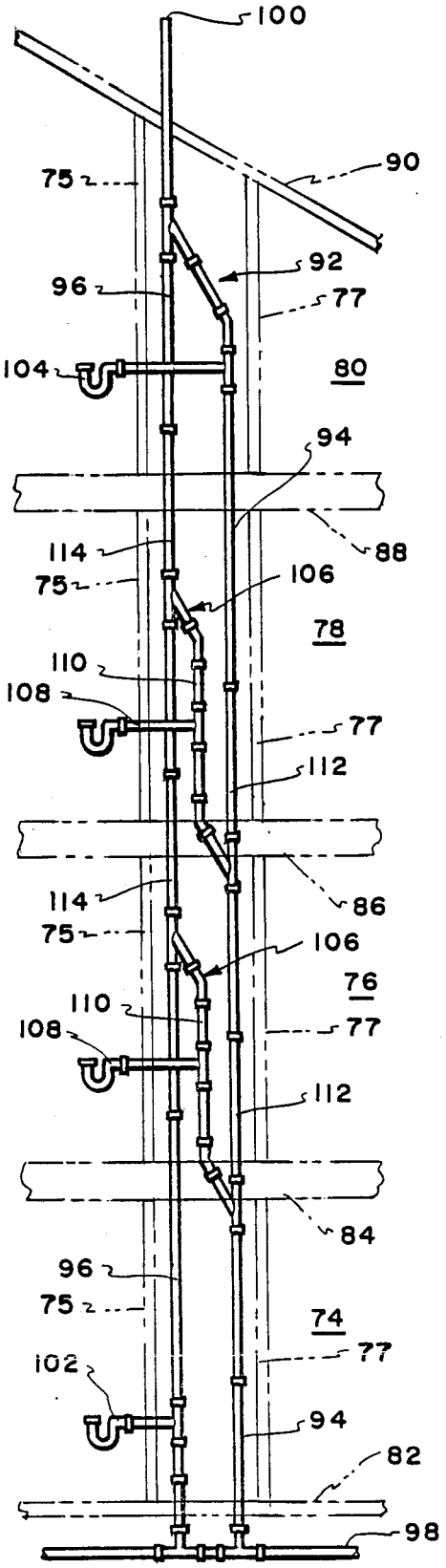
FIG. 3 is a view similar to FIG. 2 showing the apparatus of this invention to be utilized in conjunction with a four story building.

Reference now is to be had to FIG. 3 where there is shown a four-story building composed of stories 74, 76, 78 and 80. Located at the bottom surface of the story 74 is a base floor 82 with the upper surface comprising ceiling 84. The ceiling 84 also functions as a floor for story 76 with the upper surface of story 76 being enclosed by ceiling 86. Again, the ceiling 86 forms the floor for story 78 with the upper surface of the story 78 being closed by ceiling 88. Again, the ceiling 88 forms the floor of story 80 with its upper surface closed by a roof 90. It is to be noted that there are included within each of the stories 74, 76, 78 and 80 vertically oriented studs 75 and 77, similar to studs 20, 22, 24 and 26 shown in FIG. 1.

Vertically disposed between the stories 74 to 80 is a plumbing apparatus 92. Again the plumbing apparatus 92 includes a waste pipe 94 and a vent pipe 96. The lower end of the pipes 94 and 96 are connected to a sewer pipe 98 and the upper end of the waste pipe 94 connects to the vent pipe 96 adjacent the roof 90. The upper end of the vent pipe 96 is open at end 100 and is located exteriorly of the roof 90.

It is to be noted that there is only a single waste receiving drain 102 connected to the vent pipe 96 and this drain 102 is to connect to a sink and is located above the base floor 82 within the story 74. Also, a single waste receiving drain 104 is connected to the waste pipe 94 and is to connect to a sink (not shown) within the story 80.

Figure 4:
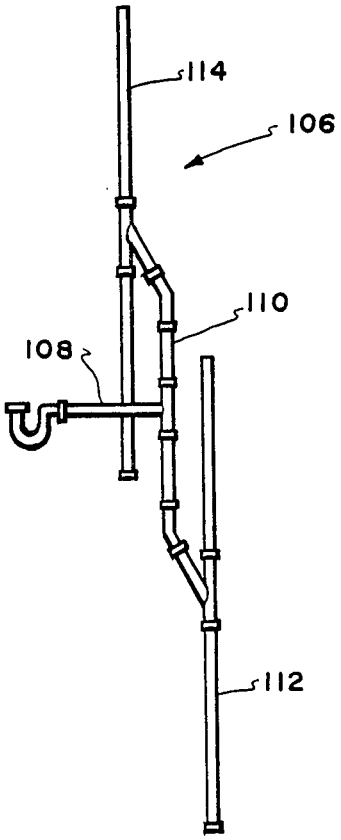
FIG. 4 is a side elevational view of a modular section which is utilized in construction of the apparatus of the present invention.

The upper portion of the combined pipes 94 and 96 located principally within story 80 is to be assembled in one single piece. Also, the portion of the pipes 94 and 96 which is to be located within the story 74 is also assembled in one piece. There is also to be assembled exteriorly of the job site intermediate sections of piping such as is clearly shown in FIG. 4. This intermediate section of piping 106 includes a drain pipe 108 which is connected to a connecting pipe 110. The lower end of the pipe 110 connects to a waste pipe section 112 with the upper end of the connecting pipe 110 connecting with a vent pipe section 114. Piping section 106 is to be installed in place within the story 76 and also within story 78 and connected within the piping apparatus 92 as is shown within FIG. 3 of the drawings. It is to be understood that by utilizing of sections 96 that there is a modular or prefabrication of plumbing apparatus of this invention that could be utilized for any multi-storied building.

Figure 6:
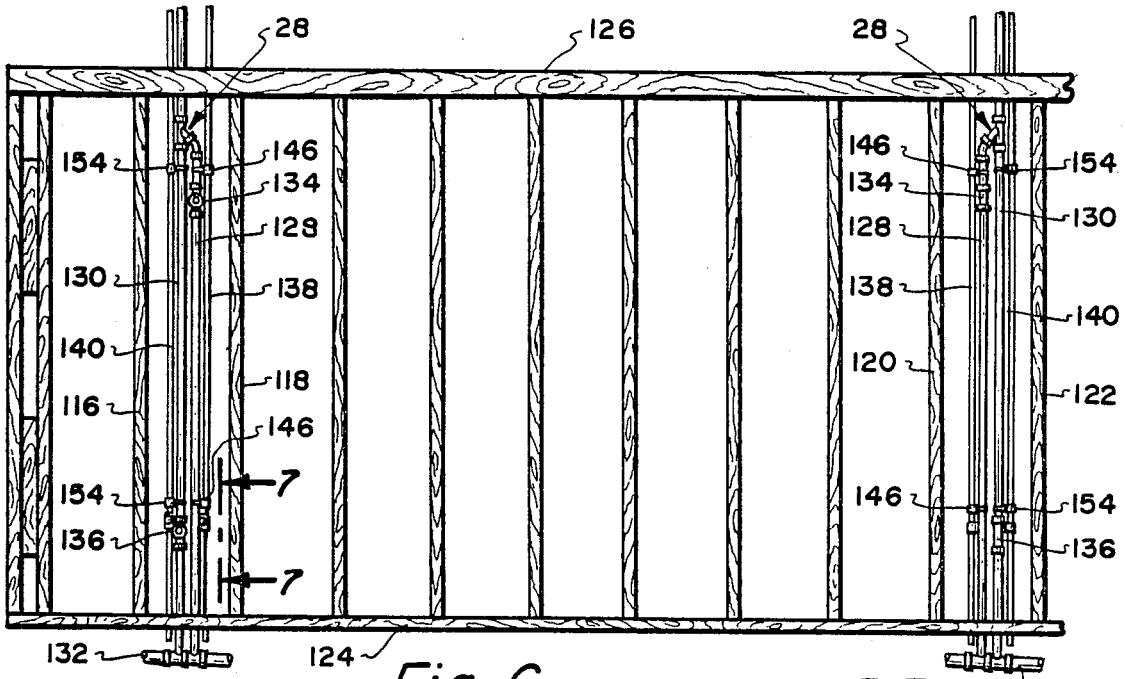
FIG. 6 is a front elevational view of the waste water plumbing apparatus of FIG. 1 but showing separate hot and cold water supply piping being affixed thereto.
Figure 7:
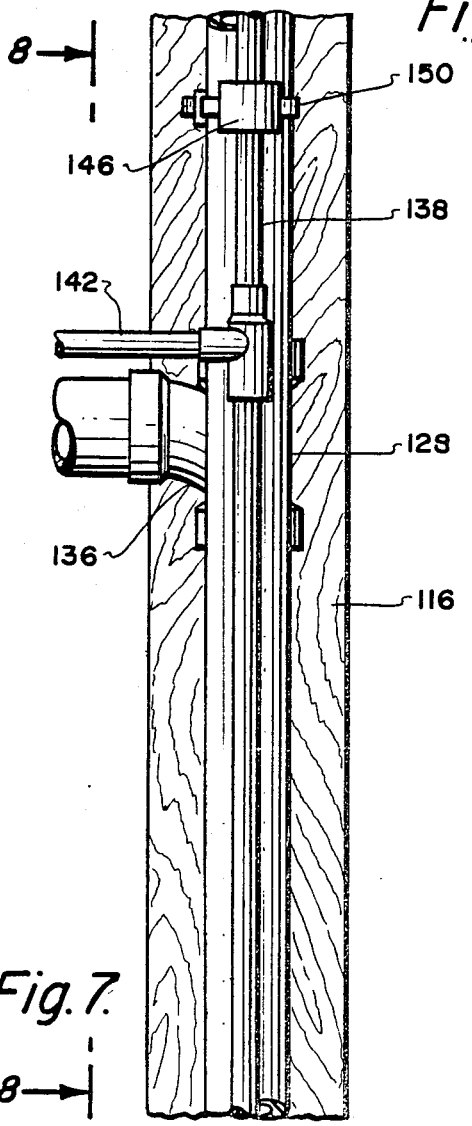
FIG. 7 is an enlarged side view of a portion of the plumbing apparatus of FIG. 6 taken along line 7—7 of FIG. 6.
Figure 8:
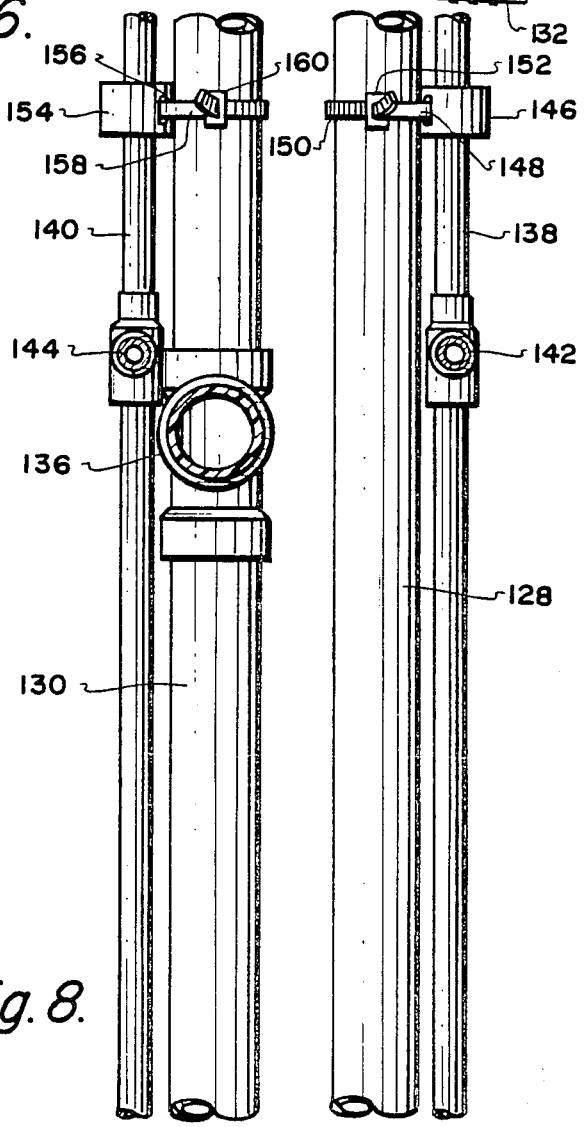
FIG. 8 is an enlarged front view (similar to FIG. 6) of a portion of the plumbing apparatus of this invention taken along line 8—8 of FIG. 7.

Referring particularly to FIGS. 6 through 8 of the drawings, there is shown the plumbing apparatus 28 located between a first pair of studs 116 and 118. Also, a second plumbing apparatus 28 is shown located between a second pair of studs 120 and 122. The studs 116, 118, 120 and 122 are mounted between the base floor 124 and the first floor 126. In referring particularly to FIG. 6, the one plumbing apparatus 28 could be utilized to connect to lavatories with the other plumbing apparatus 28 being utilized to connect to bathtubs or showers. In any event, both plumbing apparatuses 28 are essentially identical.

Each plumbing apparatus 28 includes a waste pipe 128 and a vent pipe 130. The lower end of each of the pipes 128 and 130 connect with a sewer pipe 132. The pipe 128 is to connect with a waste receiving drain by connector 134. In referring to FIG. 6, the location of the connector 134 can be varied and in all probability will be varied to be nearer the floor 126. It is to be understood that the vent pipe 130 will continue some distance above the floor 126 and finally be conducted through a roof (not shown) and be open to the atmosphere. A similar waste receiving drain (not shown) is to be connected through connector 136 to the vent pipe 130. The location of this waste receiving drain is to be located nearer the floor 124 than the floor 126.

Water supply pipes 138 and 140, which are normally constructed of copper, are to be used to supply hot and cold running water to locations directly adjacent to a particular waste receiving drain. It is common that these water supply pipes 130 and 140 are installed separately within the building structure. These water supply pipes are to receive water from supply pipes 142 and 144. Supply pipe 142 connects to a source (not shown) to supply water to pipe 138. In a similar manner, the pipe 144 connects to a source (not shown) to supply water into the pipe 140.

Pipe 138 is mounted within an encircling grommet 146 with actually there being shown two such encircling grommets 146 mounted on the pipe 138 in a spaced apart manner. Each of the grommets 146 include a split and include an interior central opening. The grommets can be split apart along the split and slipped over the pipe 138 with the pipe being located in the internal central opening. The location of the pipe within the internal central opening is accomplished in a snug type manner. Each of the grommets 146 include a slot arrangement 148. Through this slot arrangement 148 is located a clamping band 150. This clamping band is to be slipped around the pipe 128 and stretched taut and secured in a snug-fitting manner on the pipe 128 by a buckle assembly 152. In this manner, the pipe 138 is secured to the pipe 128 with the plumbing assembly being transported to the job site including the water supply pipes being attached thereto forming a completed prefabricated assembly. It would be only necessary to connect the supply pipe 142 to the pipe 138 and also connect the opposite end of the supply pipe to its appropriate exit location which would generally be a sink, toilet or shower.

In a similar manner, it is to be understood that a pair of encircling grommets 154 are mounted on the pipe 140. Connecting with the grommets 154 through slot assembly 156 is a band 158. This band is to be tightened by means of a buckle assembly 160. The band 158 secures the pipe 140 in position on the pipe 130.

What is claimed is:

1. In combination with a building structure having a plurality of stories located in a vertically stacked arrangement, said building structure having a base floor at its lowest level and a roof at its highest level, said building structure having walls, each said wall being formed of a series of spaced apart studs, a discharge sewer line located directly adjacent said base floor, a waste water plumbing apparatus extending between said stories and generally disposed in a vertically oriented manner, said waste water plumbing apparatus being located between a single pair of directly adjacent said studs, said waste water plumbing apparatus to be prefabricated at a manufacturing facility and then transported to be used at the job site, said waste water plumbing apparatus being standardized with the exact waste water plumbing apparatus to be usable at a plurality of job sites, said discharge sewer line being located substantially horizontal and is adapted to connect with a plurality of said waste water plumbing apparatuses, said waste water plumbing apparatus comprising:

a vent pipe, one end of said vent pipe being connected to said discharge sewer line, the opposite end of said vent pipe being located directly adjacent said roof, said opposite end being open to the ambient;

a first water supply pipe connected by first attaching means to said vent pipe, said first water supply pipe located in juxtaposition with said vent pipe, said first water supply pipe being substantially similar in length to said vent pipe;

a waste pipe, said waste pipe terminating in an upper end and a lower end, said lower end connecting with said discharge sewer line, said upper end connecting with said vent pipe directly adjacent to said roof, said waste pipe being in close proximity with said vent pipe;

a second water supply pipe connected by second attaching means to said waste pipe, said second water supply pipe located in juxtaposition with said waste pipe, said second water supply pipe being substantially similar in length to said waste pipe, said second water supply pipe being identical to said first water supply pipe;

a first waste receiving drain adapted to connect with a waste depositing receptacle, said first waste receiving drain connecting directly with said vent pipe with said first waste receiving drain being the only said drain connected directly to said vent pipe; and a second waste receiving drain connecting directly with said waste pipe, said second waste receiving drain adapted to connect with a waste depositing receptacle with said second waste receiving drain being the only said drain connected directly to said waste pipe, whereby waste material deposited within either said waste pipe or said vent pipe is conducted directly into said discharge sewer line so that any clogging of said waste pipe will not interfere with the normal operation of said vent pipe and vice versa.

2. The combination as defined in claim 1 wherein:

said vent pipe and said waste pipe being physically connected together entirely along the longitudinal length of said waste pipe.

3. The combination as defined in claim 1 wherein:

said first and second attaching means comprising a clamping band assembly.

* * * * *